US009982327B2

(12) United States Patent
Yamada et al.

(10) Patent No.: US 9,982,327 B2
(45) Date of Patent: May 29, 2018

(54) BRASS ALLOY FOR TAP WATER SUPPLY MEMBER

(71) Applicant: KURIMOTO, LTD., Osaka (JP)

(72) Inventors: Hiroshi Yamada, Osaka (JP); Masaaki Yamamoto, Osaka (JP)

(73) Assignee: KURIMOTO, LTD., Osaka (JP)

( * ) Notice: Subject to any disclaimer, the term of this patent is extended or adjusted under 35 U.S.C. 154(b) by 260 days.

(21) Appl. No.: 14/386,481

(22) PCT Filed: Feb. 21, 2013

(86) PCT No.: PCT/JP2013/054362
§ 371 (c)(1),
(2) Date: Sep. 19, 2014

(87) PCT Pub. No.: WO2013/145964
PCT Pub. Date: Oct. 3, 2013

(65) Prior Publication Data

US 2015/0071813 A1 Mar. 12, 2015

(30) Foreign Application Priority Data

Mar. 30, 2012 (JP) ..... 2012-078870
May 28, 2012 (WO) ..... PCT/JP2012/064343

(51) Int. Cl.
*C22C 9/04* (2006.01)

(52) U.S. Cl.
CPC ..... *C22C 9/04* (2013.01)

(58) Field of Classification Search
CPC ..... C22C 9/04
See application file for complete search history.

(56) References Cited

U.S. PATENT DOCUMENTS 5,653,827 A * 8/1997 Kramer ..... C22C 9/04 148/433
8,968,492 B2 * 3/2015 Uchida ..... C22C 9/04 148/432

(Continued)

FOREIGN PATENT DOCUMENTS

EP 2 208 802 7/2010
JP 3919574 2/2007

(Continued)

OTHER PUBLICATIONS

International Search Report dated Apr. 2, 2013 in International (PCT) Application No. PCT/JP2013/054362.

(Continued)

*Primary Examiner* — Jie Yang
(74) *Attorney, Agent, or Firm* — Wenderoth, Lind & Ponack, L.L.P.

(57) ABSTRACT

A brass alloy is provided having good mechanical properties and castability, and excellent general-purpose properties, while its dezincification corrosion is inhibited. The brass alloy contains 0.4% by mass or more and 3.2% by mass or less of Al; 0.001% by mass or more and 0.3% by mass or less of P; 0.1% by mass or more and 4.5% by mass or less of Bi; 0% by mass or more and 5.5% by mass or less of Ni; 0% by mass or more and 0.5% by mass or less of Mn, Fe, Pb, Sn, Si, Mg, and Cd, respectively; and Zn; the balance being Cu and a trace element or elements. The zinc equivalent (Zneq) calculated from the content of Zn and other elements, and the content of Al (% by mass) satisfy the following Equations (1) and (2):

$$Zneq+1.7\times Al\geq 35.0 \quad (1)$$

$$Zneq-0.45\times Al\leq 37.0 \quad (2).$$

4 Claims, 7 Drawing Sheets

(56) References Cited

U.S. PATENT DOCUMENTS

| | | | |
|---|---|---|---|
| 2009/0016927 | A1 | 1/2009 | Oishi |
| 2011/0002809 | A1 | 1/2011 | Lo et al. |

FOREIGN PATENT DOCUMENTS

| | | |
|---|---|---|
| JP | 2007-211310 | 8/2007 |
| JP | 4095666 | 3/2008 |
| JP | 2010-242184 | 10/2010 |
| WO | 2006/016630 | 2/2006 |

OTHER PUBLICATIONS

Notification of Reasons for Refusal dated Dec. 19, 2013 in corresponding Japanese Application No. 2013-543427, with English translation.

* cited by examiner (a)

(b)

(a)

(b)

BRASS ALLOY FOR TAP WATER SUPPLY MEMBER

TECHNICAL FIELD

The present invention relates to a brass alloy containing zinc, and more specifically to a brass alloy for use in a member for water works.

BACKGROUND ART

A copper alloy containing from 20 to 40% of zinc, referred to as "brass", has an excellent castability, ductility and machinability, as well as an excellent appearance with a gold-like luster. For example, Patent Document 1 discloses a brass alloy for use in materials and equipment for water works containing from 27 to 35% of zinc and from 1 to 3% of aluminium.

PRIOR ART DOCUMENTS

Patent Documents

Patent Document 1: JP 3919574 B

SUMMARY OF THE INVENTION

Problems to be Solved by the Invention

However, when a brass alloy having a high zinc content is brought into contact with tap water in which various components are dissolved, zinc, whose standard electrode potential is lower than copper, is more easily dissolved. Particularly, in an equilibrium state of brass, the dissolution of zinc is more likely to occur in regions having a crystal structure called β-phase with a high concentration of zinc. When the dezincification corrosion as described above occurs, not only the components of the alloy may dissolve into tap water, but also the surface of the alloy may deteriorate, resulting in a decrease in the waterproof performance of the valves and the like.

On the other hand, the alloy disclosed in Patent Document 1, composed solely of α-phase which is less susceptible to dissolution, had problems in machinability and castability. Further, the alloy composed solely of α-phase may have limited applications.

Accordingly, an object of the present invention is to provide a brass alloy having good mechanical properties, machinability, and castability, and excellent general-purpose properties, while inhibiting dezincification corrosion.

Means for Solving the Problems

The present invention has solved the above mentioned problems by a brass alloy comprising: 0.4% by mass or more and 3.2% by mass or less of Al; 0.001% by mass or more and 0.3% by mass or less of P; 0.1% by mass or more and 4.5% by mass or less of Bi; and Zn; wherein the zinc equivalent (Zneq) calculated from the content of Zn and other elements, and the content of Al (% by mass) satisfy the following two Equations (1) and (2):

$$Zneq+1.7\times Al\geq 35.0 \quad (1)$$

$$Zneq-0.45\times Al\leq 37.0 \quad (2)$$

Particularly, the alloy of the present invention is characterized by containing P and Al in combination, containing Al and other elements in a balanced ratio based on the zinc equivalent, and containing Bi. Although P exhibits a deoxidizing effect or dezincification corrosion resistance effect on a copper alloy by itself, coexistence with Al leads to formation of Al—P compounds, thereby improving the machinability. It should be noted, however, that the amount of the compounds formed must be appropriately adjusted, since too large an amount of the compound leads to a decrease in the mechanical properties. Further, Bi improves the machinability as the above described Al—P compounds do. In cases where the brass alloy does not contain a certain amount or more of Bi, the machinability required for a brass alloy for use in a member for water works cannot be ensured.

Further, evaluation was not based on the Zn content alone, but on the zinc equivalent, Zneq, which is a value incorporating the influence of other elements contained in the alloy. The zinc equivalent is an equivalent used to predict the metal texture of the alloy in cases where the brass alloy contains other elements. In the present invention, good mechanical properties can be ensured while inhibiting dezincification corrosion, since Equations (1) and (2) are employed as limitations in order to control the phase boundary between the α-phase and the β-phase specific to brass.

Since Ni shows a negative contribution to the zinc equivalent, incorporating an appropriate amount of Ni as the other element not only makes the alloy less susceptible to dezincification corrosion, but also improves the performance of the alloy in overall properties.

Further, the addition of B as the other element promotes the refinement of the texture, thereby contributing to the improvement in the dezincification corrosion resistance and castability, particularly, to the prevention of casting cracks.

The alloy may also contain Mn, Fe, Pb, Sn, Si, Mg, Cd and the like, to the extent that the effect of the present invention is not impaired. It should be noted, however, that it is necessary that the values after conversion fall within the above described range, since these elements are related to the zinc equivalent. In addition, since Pb and Cd, among others, are toxic by themselves, the content of these elements is preferably very low, more preferably, not more than an amount which can be considered almost zero. In addition, the alloy may also contain a trace element(s) such as a unavoidable impurity or impurities introduced into the alloy during the production process, to the extent that they do not interfere with the effect of the present invention and that they are not practically harmful.

Effect of the Invention

The present invention provides a well-balanced brass alloy excellent in handleability, having sufficient mechanical properties and machinability, while inhibiting dezincification corrosion by controlling the metal texture. The alloy can be suitably used in a member for water works since the dezincification corrosion can be efficiently inhibited and the dissolution is less likely to occur, even when the alloy is used in forging, copper rolling or the like, not just in casting.

MODE FOR CARRYING OUT THE INVENTION

Figure 1:
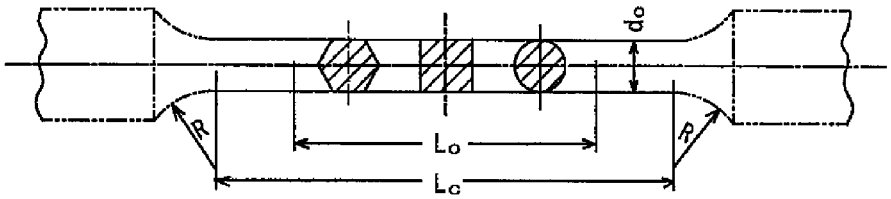
FIG. 1 is a schematic diagram of the test specimen used in the Tensile test in Examples.

The present invention will now be specifically described. The present invention relates to a brass alloy which contains at least Zn, Al, Bi and P. The influence of Zn and other elements are defined by a range in terms of the zinc equivalent described later, to inhibit dezincification corrosion.

It is necessary that the brass alloy of the present invention contain 0.4% by mass or more of Al. Preferably, the Al content is 1.0% by mass or more. The incorporation of Al serves to improve the tensile strength of the brass alloy, even when the zinc equivalent is the same. Further, the machinability of the alloy can be improved, because Al—P compounds having a good machinability are formed between Al and P described later. It should be noted, however, that if the Al content is less than 0.4% by mass, the dezincification corrosion resistance may not be ensured, even under the coexistence with P. The Al content is preferably 1.0% by mass or more, because too low an Al content makes the effect of improving the machinability due to formation of the Al—P compounds slightly less pronounced, even though the dezincification corrosion resistance is ensured. In addition, it is necessary to contain Al in an amount not less than the lower limit, which is defined in relation with the zinc equivalent described later. On the other hand, too high an Al content leads to an excessive formation of Al—P compounds, which results in an improvement in the machinability, but also in an unignorable deterioration of castability. Therefore, it is necessary that the Al content be 3.2% by mass or less. Preferably, the content is 3.0% by mass or less, more preferably, 2.5% by mass or less.

It is necessary that the brass alloy of the present invention contain 0.001% by mass or more of P. Preferably, the P content is 0.01% by mass or more, more preferably 0.02% by mass or more. The incorporation of P produces a deoxidizing effect. The deoxidizing effect serves to prevent the occurrence of casting defects, particularly in cases where the brass alloy of the present invention is used in casting. Further, coexistence with Al allows even a small amount of P to exhibit good dezincification corrosion resistance. In addition, sufficient machinability can be ensured by forming the Al—P compounds and by allowing them to act with Bi described later. This is because the compounds serve as chip breakers to finely break machining chips during machining. In cases where the P content is less than 0.001% by mass, these effects, particularly the effect of dezincification corrosion resistance, may be insufficient. At the same time, it is necessary that P content be 0.3% by mass or less. Preferably, the content is 0.2% by mass or less. A P content of more than 0.3% by mass leads to an excessive formation of Al—P compounds, resulting not only in a deterioration of castability but also in a significant decrease in the elongation.

It is necessary that the brass alloy of the present invention contain 0.1% by mass or more of Bi. Preferably, the Bi content is 0.4% by mass or more. Bi dramatically improves the machinability of the alloy while providing the dezincification corrosion resistance, by being finely dispersed in the alloy. However, if the Bi content is less than 0.1% by mass, the required machinability cannot be obtained. If the Bi content is 0.4% by mass or more, a good machinability and a marked dezincification corrosion resistance can be obtained. On the other hand, too high a Bi content tends to decrease the elongation, and therefore, it is necessary that the Bi content be 4.5% by mass or less. Preferably, the content is 3.0% by mass or less. Further, a Bi content of 2.0% by mass or less is more preferred, because a marked dezincification corrosion resistance can be obtained.

The brass alloy of the present invention may contain Ni. Ni has a negative contribution effect on the zinc equivalent described later, and exhibits the effect of inhibiting dezincification corrosion. In order to fully bring out this effect, the Ni content is preferably 0.5% by mass or more. Since, on the other hand, too high a Ni content results in a decreased flowability of molten metal and increased gas absorption, it is necessary that the Ni content be 5.5% by mass or less. If the content is 2.5% by mass or less, more stable properties can be easily obtained.

The brass alloy of the present invention may contain B as the other trace element. B is effective in the refinement of the cast texture, particularly, in the refinement of the α-phase, and it serves to improve the dezincification corrosion resistance and to prevent casting cracks in castings with complex shapes. In order to fully bring out this effect, the B content is preferably 0.001% by mass or more, more preferably, 0.003% by mass or more. On the other hand, too high a content results in a decrease in machinability due to formation of hard intermetallic compounds or a decrease in castability due to gas defects and the like. Therefore, it is necessary that the B content be 0.1% by mass or less. If the B content is 0.05% by mass or less, a more stable casting can be obtained.

The brass alloy of the present invention may contain Mn, Fe, Pb, Sn, Si, Mg and Cd, in addition to the above described elements. It should be noted, however, that each of these elements is related to the zinc equivalent described later, and the blending ratio thereof is limited by the range defined by the zinc equivalent described later, in terms of maintaining the dezincification corrosion resistance. It is necessary that the content of these elements be 0.5% by mass or less, respectively, since too high a content may interfere with the effect of the present invention. Further, Pb and Cd are toxic by themselves, and there is a concern that these components may dissolve into the water particularly in cases where the alloy is used in a member for water works. Therefore, the content of Pb and Cd is preferably not more than the amount contained as a unavoidable impurity(ies), more preferably, not more than the detection limit.

The amount of Zn contained in the brass alloy of the present invention is defined by the zinc equivalent Zneq, together with the content of the above mentioned elements. The zinc equivalent is represented by Equation (3) below:

$$Zneq=\{(Zn+\Sigma qi\cdot ti)/(Cu+Zn+\Sigma qi\cdot ti)\}\times 100 \quad (3)$$

(Cu: the content of Cu (% by mass) in the alloy, Zn: the content of Zn (% by mass) in the alloy, qi=the content of elements other than Cu and Zn (% by mass), ti =the equivalent value of each of the elements shown in Table 1 below)

TABLE 1

| | Mn | Fe | Pb | Sn | Ni | Si | Mg | Cd | Al |
|---|---|---|---|---|---|---|---|---|---|
| Equivalent ti value | 0.5 | 0.9 | 1.0 | 2.0 | −1.3 | 10.0 | 2.0 | 1.0 | 6 |

It is necessary that the relationship between the zinc equivalent Zneq and the Al content of the brass alloy of the present invention satisfy the relationship represented by Equation (1) below. Preferably, the relationship between the zinc equivalent Zneq and the Al content satisfies the relationship represented by Equation (4) below. If the condition represented by Equation (1) is not satisfied, good general mechanical properties of brass such as tensile strength cannot be obtained, causing practical problems. If the condition represented by Equation (4) is satisfied, sufficient tensile strength can be ensured.

Further, it is necessary that the relationship between the zinc equivalent Zneq and the Al content satisfy the condition represented by Equation (2) below. The zinc equivalent Zneq is preferably 37.2 or less. If the condition represented by Equation (2) is not satisfied, the progress of the dezincification corrosion is more likely accelerated. If the zinc equivalent Zneq is 37.2 or less, the progress of the dezincification corrosion can be sufficiently inhibited.

$$Zneq+1.7\times Al\geq 35.0 \quad (1)$$

$$Zneq+1.7\times Al\geq 37.5 \quad (4)$$

$$Zneq-0.45\times Al\leq 37.0 \quad (2)$$

(Al: the Al content (% by mass) in the alloy)

The brass alloy of the present invention may contain as a trace element(s) another element(s) other than the above described elements to the extent of the amount of unavoidable impurity(ies). It should be noted, however, that the content of these other elements is preferably low, more preferably, less than the detection limit. Specifically, the total of the content of these other elements is preferably less than 0.5% by mass.

The brass alloy of the present invention can be used in casting, in which the alloy is melted and then poured into a mold. The effect of the alloy is suitably demonstrated, especially when it is used in metal mold castings. The alloy may also be used in forged products or copper rolled products and the like. In both cases, the formation of the β-phase susceptible to dezincification corrosion can be inhibited. If the blending ratio is within the above described range, the dissolution and dezincification corrosion of the alloy can be inhibited while securing the mechanical strength and machinability of the material, even in cases where the crystal structure is unstable.

Further, the brass alloy of the present invention can be more suitably used in a member for water works which is in constant contact with tap water, not only because the dezincification corrosion can be inhibited, but also because the dissolution of toxic Pb and Cd into tap water can be prevented in cases where Pb and Cd are contained only as unavoidable impurities.

EXAMPLES

Examples in which the brass alloy of the present invention was actually prepared by blending will now be described. Firstly, evaluation methods will be described.

<Tensile Test Method>

A sample prepared by casting in a metal mold having a size of 28 mm diameter×200 mm was processed into a type 14A test specimen defined in JIS Z2241. The test specimen is a proportional test piece whose concrete shape is as shown in FIG. 1, in which the original sectional area S0 and the original gauge length L0 in the parallel portion satisfy the relationship represented by $L0=5.65\times S0^{1/2}$. The diameter d0 of the rod-like portion was 4 mm, the original gauge length L0 was 20 mm, the length Lc of the parallel portion which was cylindrical was 30 mm, and the radius R of the shoulder portions was 15 mm. (L0=5.65×12.65 (2×2×π)^½=20.04)

The test specimen was subjected to a tensile test according to JIS Z2241 and the tensile strength (MPa) and the elongation (%) were evaluated as follows. The tensile strength was defined as the maximum test force Fm, which was the force the test specimen withstood during the test until it exhibited discontinuous yielding. The elongation is the value of the permanent elongation of the test specimen obtained by testing until it ruptured, expressed in percentage relative to the original gauge length.

The tensile strength was evaluated as follows: "○" . . . 300 MPa or more, "Δ" . . . 250 MPa or more and less than 300 MPa, "x" . . . less than 250 MPa.

The elongation was evaluated as follows: "○" . . . 20% or more, "Δ" . . . 15% or more and less than 20%, "×" . . . less than 15%.

<Dezincification Corrosion Test Method>

Figure 2:
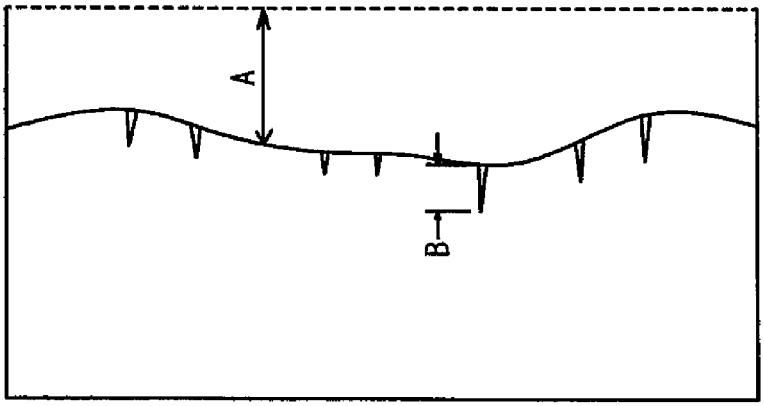
FIG. 2 is a cross sectional schematic view illustrating the dezincification depths.

A sample prepared by casting in a metal mold having a size of 28 mm diameter×200 mm was cut out into a cubic test specimen of 10 mm×10 mm×10 mm, and the test was performed according to ISO6509. Specifically, the surroundings of the test specimen was covered with an epoxy resin having a thickness of 15 mm or more such that only one surface of the test specimen was exposed from the resin. After 100 $mm^2$ of this exposed surface was polished with wet abrasive paper, the exposed surface was finished with No. 1200 abrasive paper, and washed with ethanol immediately before the test. This sample embedded in the epoxy resin with only one surface exposed was immersed in 250 mL of an aqueous 12.7 g/L cupric chloride solution at 75±5° C. for 24 hours. After the test was completed, the sample was washed with water, rinsed with ethanol, and the dezincification depth (the depth of the portion B, μm, which is the depth of further dezincification corrosion progressed from the corroded surface excluding the corrosion depth A of the entire surface, shown in FIG. 2) of its cross section was immediately measured using a light microscope. Specifically, a sample of 10 mm was divided into 5 visual fields and the dezincification depth for each visual filed was measured at the minimum and the maximum depth points. The mean value of the total 10 points was defined as the average dezincification depth, and the depth of the deepest point among these 10 points was defined as the maximum dezincification depth. They were evaluated as follows; and those having evaluations other than "×" for both depths were defined as "pass".

Average dezincification depth: "○" . . . less than 200 μm, "×" . . . 200 μm or more Maximum dezincification depth: "○" . . . less than 200 μm, "Δ" . . . 200 μm or more and less than 400 μm, "x" . . . 400 μm or more <Castability Test>

As a test of castability, the workability and influence on the product were evaluated as follows, based on the flowability of molten metal during the casting into the metal mold having a size of 28 mm diameter×200 mm when preparing the sample for use in the above described mechanical properties test and dezincification corrosion test.

The castability was evaluated as follows: "○" . . . those capable of being cast without problems, "Δ" . . . those having deterioration in workability or adverse effects on the product to some extent, but which do not cause fatal defects, "×" . . . those having deterioration in workability or adverse effects on the product, and which are inappropriate as a brass alloy for a member for water works.

In Examples and Comparative Examples of the present invention, each of the samples was prepared by melting the respective components at a respective blending ratio, and subsequent casting. The contents of each element in each sample are shown in Table 2 together with the results of the above described tests. The Cu content herein refers to the value obtained by subtracting the sum of the content of each of the elements other than Cu from the 100% by mass. "Equation A" refers to the left hand values of the above described Inequality (1) and Inequality (4), and the "Equation B" refers to the left hand value of the above described Inequality (2). Certain examples are extracted from these Examples and Comparative Examples, and they are examined for each component. Further, "overall" herein refers to the overall evaluation (hereinafter, referred to as "overall evaluation") which evaluates if the alloy is appropriate as a brass alloy for use in a member for water works. Those evaluated as "○" in all of the above described mechanical properties test, dezincification corrosion test and castability test were defined as "○", those having some "Δ" evaluations but no "×" evaluation were defined as "●", and those having at least one "×" evaluation were defined as "×".

TABLE 2-1

| | | | | | | | | | Tensile test | |
|---|---|---|---|---|---|---|---|---|---|---|
| | Zn | Al | Bi | P | Cu | Zn equivalent | Equation A | Equation B | Tensile strength (Mpa) | Elongation (%) |
| Comparative Example 1 | 23.64 | 0.91 | 0.86 | 0.056 | 74.53 | 28.08 | 29.63 | 27.67 | 153.5 | 45.7 |
| Comparative Example 2 | 21.72 | 1.72 | 0.61 | 0.078 | 75.87 | 29.69 | 32.61 | 28.92 | 187.0 | 30.9 |
| Comparative Example 3 | 32.79 | 1.03 | 1.09 | 0.054 | 65.04 | 37.47 | 39.22 | 37.01 | 430.0 | 35.2 |
| Comparative Example 4 | 31.18 | 1.58 | 0.79 | 0.060 | 66.39 | 37.98 | 40.67 | 37.27 | 413.5 | 38.8 |
| Comparative Example 5 | 33.56 | 1.01 | 0.77 | 0.032 | 64.63 | 38.01 | 39.72 | 37.55 | 369.0 | 30.0 |
| Comparative Example 6 | 30.85 | 1.77 | 0.90 | 0.026 | 66.45 | 38.43 | 41.43 | 37.63 | 394.5 | 26.4 |
| Comparative Example 7 | 30.09 | 2.04 | 0.82 | 0.042 | 67.01 | 38.71 | 42.18 | 37.80 | 395.5 | 13.7 |
| Comparative Example 8 | 32.47 | 1.58 | 0.65 | 0.058 | 65.24 | 39.14 | 41.82 | 38.42 | 421.0 | 25.2 |
| Comparative Example 9 | 26.54 | 3.14 | 0.69 | 0.094 | 69.54 | 39.49 | 44.83 | 38.08 | 541.0 | 10.3 |
| Comparative Example 10 | 30.30 | 2.19 | 1.00 | 0.056 | 66.45 | 39.53 | 43.25 | 38.54 | 465.5 | 22.7 |
| Comparative Example 11 | 24.42 | 3.69 | 1.01 | 0.066 | 70.81 | 39.67 | 45.94 | 38.01 | 519.5 | 13.2 |
| Comparative Example 12 | 28.96 | 2.62 | 1.08 | 0.090 | 67.25 | 39.92 | 44.37 | 38.74 | 463.0 | 15.5 |
| Comparative Example 13 | 30.98 | 2.20 | 0.87 | 0.024 | 65.93 | 40.12 | 43.86 | 39.13 | 407.0 | 16.9 |
| Comparative Example 14 | 31.13 | 2.21 | 0.86 | 0.038 | 65.76 | 40.30 | 44.06 | 39.30 | 428.0 | 14.2 |
| Comparative Example 15 | 28.29 | 3.12 | 0.83 | 0.053 | 67.71 | 40.98 | 46.28 | 39.58 | 467.0 | 11.7 |
| Comparative Example 16 | 31.03 | 3.02 | 0.64 | 0.092 | 65.22 | 42.98 | 48.11 | 41.62 | 515.5 | 18.4 |
| Comparative Example 17 | 36.26 | 0.00 | 0.61 | 0.066 | 63.06 | 36.51 | 36.51 | 36.51 | 362.0 | 46.5 |
| Comparative Example 18 | 37.03 | 0.00 | 0.89 | 0.075 | 62.01 | 37.39 | 37.39 | 37.39 | 380.5 | 40.5 |

TABLE 2-1-continued

| | Dezincification corrosion (μm) | | | | | | | |
|---|---|---|---|---|---|---|---|---|
| | Average depth | Maximum depth | Tensile strength | Elongation | Ave. depth | Max. depth | Castability | Overall |
| Comparative Example 1 | 24.5 | 36.2 | X | ○ | ○ | ○ | ○ | X |
| Comparative Example 2 | 6.5 | 13.4 | X | ○ | ○ | ○ | ○ | X |
| Comparative Example 3 | 211.2 | 355.1 | ○ | ○ | X | Δ | ○ | X |
| Comparative Example 4 | 243.0 | 350.2 | ○ | ○ | X | Δ | ○ | X |
| Comparative Example 5 | 245.3 | 378.6 | ○ | ○ | X | Δ | ○ | X |
| Comparative Example 6 | 343.5 | 455.8 | ○ | ○ | X | X | ○ | X |
| Comparative Example 7 | 620.2 | 780.0 | ○ | X | X | X | ○ | X |
| Comparative Example 8 | 504.7 | 711.0 | ○ | ○ | X | X | ○ | X |
| Comparative Example 9 | 267.0 | 334.4 | ○ | X | X | Δ | Δ | X |
| Comparative Example 10 | 492.8 | 586.1 | ○ | ○ | X | X | ○ | X |
| Comparative Example 11 | 432.5 | 517.4 | ○ | X | X | X | X | X |
| Comparative Example 12 | 505.7 | 637.1 | ○ | Δ | X | X | ○ | X |
| Comparative Example 13 | 482.0 | 552.0 | ○ | Δ | X | X | ○ | X |
| Comparative Example 14 | 466.2 | 570.3 | ○ | X | X | X | ○ | X |
| Comparative Example 15 | 505.1 | 593.1 | ○ | X | X | X | Δ | X |
| Comparative Example 16 | 199.3 | 416.2 | ○ | Δ | ○ | X | Δ | X |
| Comparative Example 17 | 201.4 | 368.0 | ○ | ○ | X | Δ | ○ | X |
| Comparative Example 18 | 309.9 | 454.1 | ○ | ○ | X | X | ○ | X |

TABLE 2-2

| | | | | | | | | | Tensile test | |
|---|---|---|---|---|---|---|---|---|---|---|
| | Zn | Al | Bi | P | Cu | Zn equivalent | Equation A | Equation B | Tensile strength (Mpa) | Elongation (%) |
| Example 1 | 17.93 | 2.80 | 0.92 | 0.068 | 78.28 | 30.73 | 35.49 | 29.47 | 252.0 | 47.5 |
| Example 2 | 25.81 | 1.58 | 0.84 | 0.078 | 71.69 | 32.99 | 35.67 | 32.28 | 276.5 | 55.2 |
| Example 3 | 25.61 | 1.70 | 1.01 | 0.010 | 71.67 | 33.32 | 36.21 | 32.56 | 266.0 | 63.7 |
| Example 4 | 21.35 | 2.77 | 0.89 | 0.058 | 74.93 | 33.63 | 38.34 | 32.38 | 285.5 | 50.9 |
| Example 5 | 29.31 | 0.97 | 0.81 | 0.062 | 68.85 | 33.79 | 35.43 | 33.35 | 255.5 | 50.2 |
| Example 6 | 22.69 | 2.79 | 0.69 | 0.080 | 73.75 | 34.84 | 39.58 | 33.58 | 370.5 | 40.4 |
| Example 7 | 30.85 | 0.95 | 0.88 | 0.056 | 67.26 | 35.21 | 36.82 | 34.78 | 292.0 | 49.9 |
| Example 8 | 24.05 | 2.85 | 0.80 | 0.080 | 72.22 | 36.30 | 41.14 | 35.01 | 369.0 | 20.3 |
| Example 9 | 33.97 | 0.50 | 0.73 | 0.044 | 64.76 | 36.34 | 37.19 | 36.12 | 296.0 | 43.1 |
| Example 10 | 31.38 | 1.35 | 0.84 | 0.060 | 66.37 | 37.30 | 39.59 | 36.69 | 385.0 | 42.5 |
| Example 11 | 24.84 | 3.11 | 0.97 | 0.076 | 71.00 | 37.99 | 43.28 | 36.59 | 438.5 | 25.1 |
| Example 12 | 24.81 | 2.17 | 1.02 | 0.048 | 71.95 | 34.46 | 38.15 | 33.48 | 326.0 | 43.0 |
| Example 13 | 24.98 | 2.20 | 0.82 | 0.052 | 71.95 | 34.67 | 38.41 | 33.68 | 315.5 | 51.7 |
| Example 14 | 25.44 | 2.23 | 0.98 | 0.060 | 71.29 | 35.26 | 39.05 | 34.25 | 367.5 | 41.0 |
| Example 15 | 28.55 | 1.54 | 0.91 | 0.044 | 68.96 | 35.40 | 38.02 | 34.71 | 309.0 | 47.2 |
| Example 16 | 24.75 | 2.44 | 0.95 | 0.112 | 71.75 | 35.44 | 39.59 | 34.34 | 398.0 | 41.8 |
| Example 17 | 26.02 | 2.28 | 0.86 | 0.016 | 70.82 | 35.92 | 39.80 | 34.90 | 363.5 | 45.0 |
| Example 18 | 27.14 | 2.01 | 0.91 | 0.080 | 69.86 | 35.94 | 39.36 | 35.04 | 388.5 | 38.7 |
| Example 19 | 28.12 | 1.79 | 0.86 | 0.170 | 69.06 | 36.01 | 39.05 | 35.20 | 312.3 | 22.2 |
| Example 20 | 25.96 | 2.32 | 0.87 | 0.040 | 70.81 | 36.03 | 39.97 | 34.98 | 384.9 | 43.9 |
| Example 21 | 25.67 | 2.41 | 0.89 | 0.140 | 70.89 | 36.15 | 40.24 | 35.06 | 331.0 | 20.1 |
| Example 22 | 29.35 | 1.58 | 0.75 | 0.064 | 68.26 | 36.26 | 38.95 | 35.55 | 368.0 | 39.5 |
| Example 23 | 25.89 | 2.41 | 0.81 | 0.072 | 70.82 | 36.30 | 40.39 | 35.21 | 373.0 | 39.7 |
| Example 24 | 25.66 | 2.40 | 1.63 | 0.092 | 70.22 | 36.33 | 40.41 | 35.25 | 369.5 | 33.2 |
| Example 25 | 26.03 | 2.46 | 0.17 | 0.026 | 71.31 | 36.39 | 40.57 | 35.28 | 389.0 | 40.8 |
| Example 26 | 31.81 | 1.01 | 0.86 | 0.076 | 66.24 | 36.37 | 38.09 | 35.92 | 367.5 | 32.7 |

TABLE 2-2-continued

| | | | | | | | | | | |
|---|---|---|---|---|---|---|---|---|---|---|
| Example 27 | 27.98 | 1.97 | 0.91 | 0.059 | 69.09 | 36.55 | 39.90 | 35.66 | 360.5 | 47.6 |
| Example 28 | 25.73 | 2.47 | 2.08 | 0.050 | 69.67 | 36.79 | 40.99 | 35.68 | 380.5 | 29.7 |
| Example 29 | 26.08 | 2.36 | 2.97 | 0.116 | 68.47 | 37.01 | 41.03 | 35.95 | 367.5 | 22.6 |
| Example 30 | 27.84 | 2.16 | 0.83 | 0.034 | 69.14 | 37.11 | 40.78 | 36.14 | 399.0 | 40.1 |

| | Dezincification corrosion (μm) | | | | | | | |
|---|---|---|---|---|---|---|---|---|
| | Average depth | Maximum depth | Tensile strength | Elongation | Ave. depth | Max. depth | Castability | Overall |
| Example 1 | 5.7 | 7.9 | Δ | ○ | ○ | ○ | Δ | ● |
| Example 2 | 17.5 | 30.8 | Δ | ○ | ○ | ○ | ○ | ● |
| Example 3 | 27.6 | 34.6 | Δ | ○ | ○ | ○ | ○ | ● |
| Example 4 | 28.3 | 33.1 | Δ | ○ | ○ | ○ | Δ | ● |
| Example 5 | 10.9 | 24.6 | Δ | ○ | ○ | ○ | ○ | ● |
| Example 6 | 16.8 | 30.0 | ○ | ○ | ○ | ○ | Δ | ● |
| Example 7 | 84.5 | 176.3 | Δ | ○ | ○ | ○ | ○ | ● |
| Example 8 | 90.0 | 151.4 | ○ | ○ | ○ | ○ | Δ | ● |
| Example 9 | 95.0 | 287.8 | Δ | ○ | ○ | Δ | ○ | ● |
| Example 10 | 189.2 | 332.6 | ○ | ○ | ○ | Δ | ○ | ● |
| Example 11 | 179.8 | 306.2 | ○ | ○ | ○ | Δ | Δ | ● |
| Example 12 | 11.8 | 20.2 | ○ | ○ | ○ | ○ | ○ | ○ |
| Example 13 | 34.3 | 72.3 | ○ | ○ | ○ | ○ | ○ | ○ |
| Example 14 | 12.7 | 25.3 | ○ | ○ | ○ | ○ | ○ | ○ |
| Example 15 | 85.5 | 173.3 | ○ | ○ | ○ | ○ | ○ | ○ |
| Example 16 | 24.7 | 46.6 | ○ | ○ | ○ | ○ | ○ | ○ |
| Example 17 | 13.4 | 81.8 | ○ | ○ | ○ | ○ | ○ | ○ |
| Example 18 | 42.9 | 101.2 | ○ | ○ | ○ | ○ | ○ | ○ |
| Example 19 | 20.5 | 23.8 | ○ | ○ | ○ | ○ | ○ | ○ |
| Example 20 | 35.4 | 82.0 | ○ | ○ | ○ | ○ | ○ | ○ |
| Example 21 | 24.9 | 46.5 | ○ | ○ | ○ | ○ | ○ | ○ |
| Example 22 | 29.1 | 66.0 | ○ | ○ | ○ | ○ | ○ | ○ |
| Example 23 | 23.3 | 66.2 | ○ | ○ | ○ | ○ | ○ | ○ |
| Example 24 | 24.2 | 48.3 | ○ | ○ | ○ | ○ | ○ | ○ |
| Example 25 | 58.5 | 147.8 | ○ | ○ | ○ | ○ | ○ | ○ |
| Example 26 | 82.1 | 174.2 | ○ | ○ | ○ | ○ | ○ | ○ |
| Example 27 | 96.5 | 178.6 | ○ | ○ | ○ | ○ | ○ | ○ |
| Example 28 | 49.7 | 110.0 | ○ | ○ | ○ | ○ | ○ | ○ |
| Example 29 | 99.3 | 180.0 | ○ | ○ | ○ | ○ | ○ | ○ |
| Example 30 | 110.6 | 190.0 | ○ | ○ | ○ | ○ | ○ | ○ |

Comparative Examples 3 to 16 and 18 are examples in which the relationship between the zinc equivalent and the Al content does not satisfy the condition represented by Inequality (2); and Comparative Examples 1 and 2 are examples in which the relationship does not satisfy the condition represented by the above described Inequality (1). In Comparative Example 11, not only the above described Inequality (2) is not satisfied, but also the Al content exceeds the upper limit. On the other hand, Al is not contained in Comparative Examples 17 and 18.

<Regarding the Measured Data of the Dezincification Depth>

Among the observed data of the dezincification corrosion depth obtained in the above described dezincification corrosion test, selected photographs of characteristic examples are shown, in which the inhibition of the dezincification corrosion becomes difficult as the zinc equivalent increases.

Figure 3:
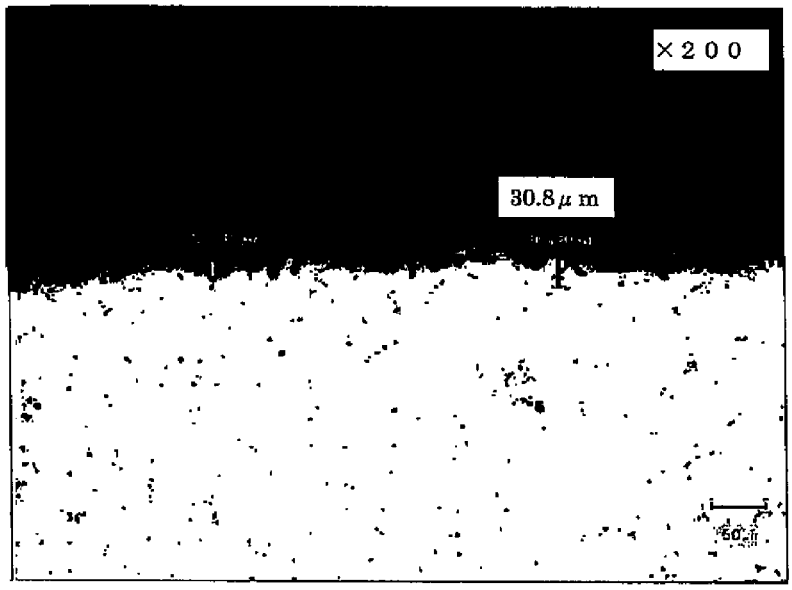
FIG. 3 is a macro photograph of the cross section of Example 2, taken at a magnification of 200 times.

A macro photograph of the cross section of the sample of Example 2 whose zinc equivalent is 32.99, taken at a magnification of 200 times, is shown in FIG. 3. Several noticeable shallow corroded regions were observed on the surface, and the deepest of all was observed on the right side of FIG. 3. As a result of the measurement, the average dezincification corrosion depth (hereinafter referred to as "average depth") was 17.5 μm, and the maximum dezincification corrosion depth (hereinafter referred to as "maximum depth") was 30.8 μm.

Figure 4:
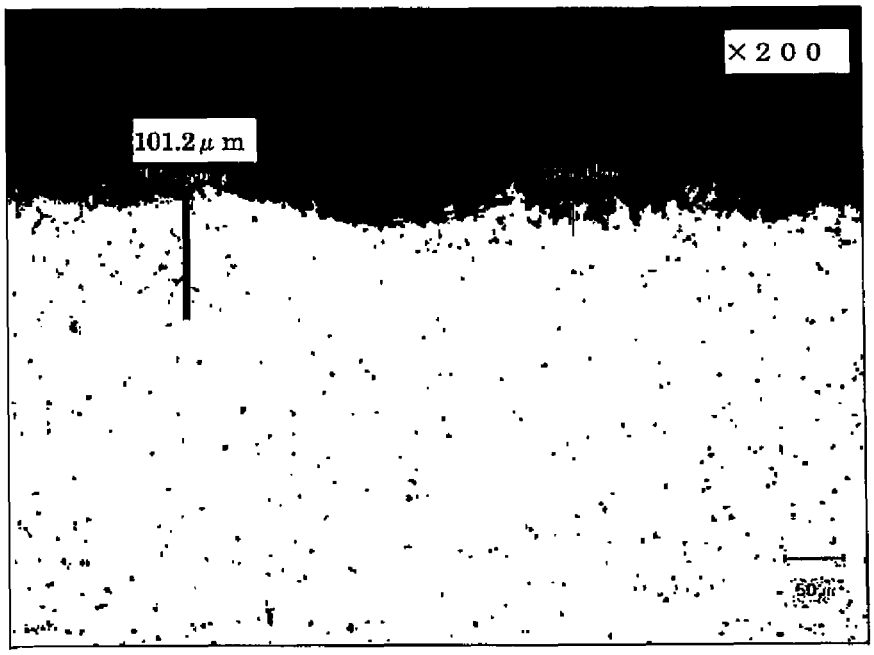
FIG. 4 is a macro photograph of the cross section of Example 18, taken at a magnification of 200 times.

A macro photograph of the cross section of the sample of Example 18 whose zinc equivalent is 35.94, taken at a magnification of 200 times, is shown in FIG. 4. Not only noticeable shallow corroded regions due to dezincification corrosion were observed on the surface, but also the slight progress of the discontinuous dezincification phenomenon was confirmed. The deepest of all corroded regions was observed on the left side of FIG. 4. As a result of the measurement, the average depth was 42.9 μm, the maximum depth was 101.2 μm, and the numerical values of the average and the maximum depths were about three times the values of those in Example 2 shown in FIG. 3, respectively.

Figure 5:
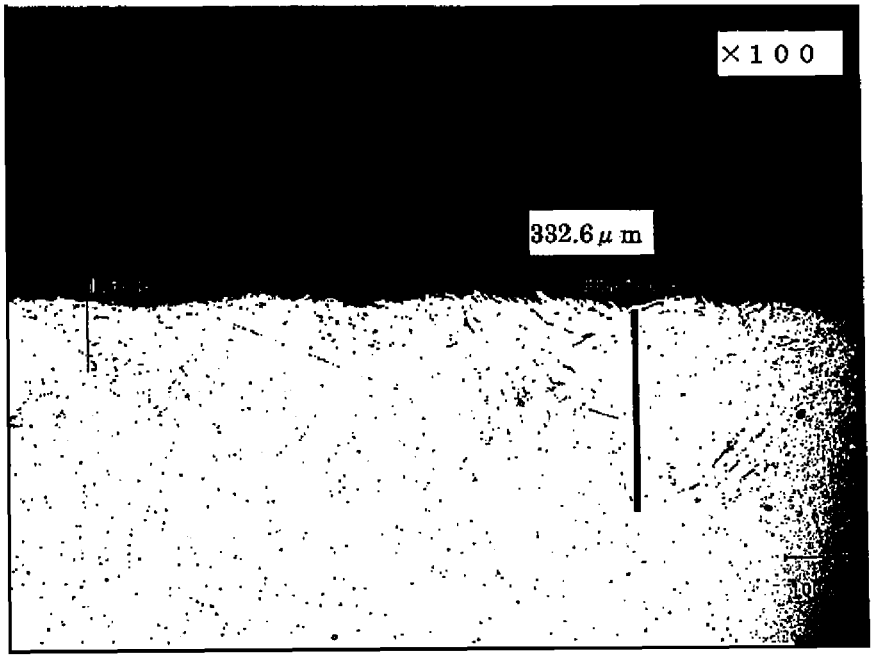
FIG. 5 is a macro photograph of the cross section of Example 10, taken at a magnification of 100 times.

A macro photograph of the cross section of the sample of Example 10 whose zinc equivalent is 37.30, taken at a magnification of 100 times, is shown in FIG. 5. It should be noted, however, that the magnification of FIG. 5 is half of that of FIG. 3 and FIG. 4. The slight progress of the discontinuous dezincification phenomenon was observed, and the deepest of all corroded regions was observed on the right side of FIG. 5. As a result of the measurement, the average depth was 189.2 μm, the maximum depth was 332.6 μm, and the maximum depth was evaluated as "Δ".

Figure 6:
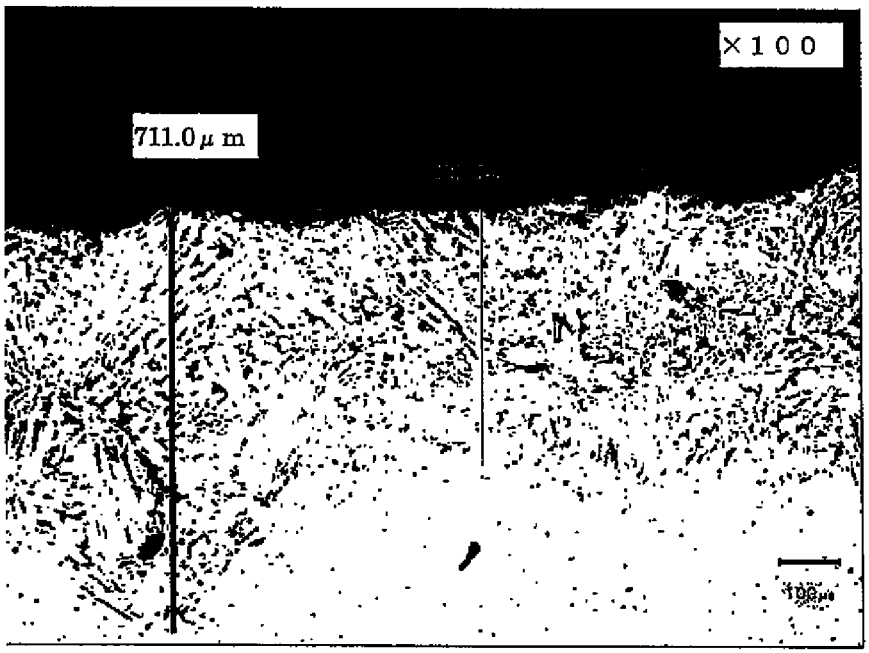
FIG. 6 is a macro photograph of the cross section of Comparative Example 8, taken at a magnification of 100 times.

A macro photograph of the cross section of the sample of Comparative Example 8 whose zinc equivalent is 39.14, taken at a magnification of 100 times, is shown in FIG. 6. It can be clearly seen that the discontinuous dezincification phenomenon has extended deep into the interior of the sample, and it can be inferred that the dezincification corrosion extends over the entire β-phase. As a result of the measurement, the average depth was 504.7 μm, the maximum depth was 711.0 μm, and the both depths were evaluated as "×".

Figure 7:
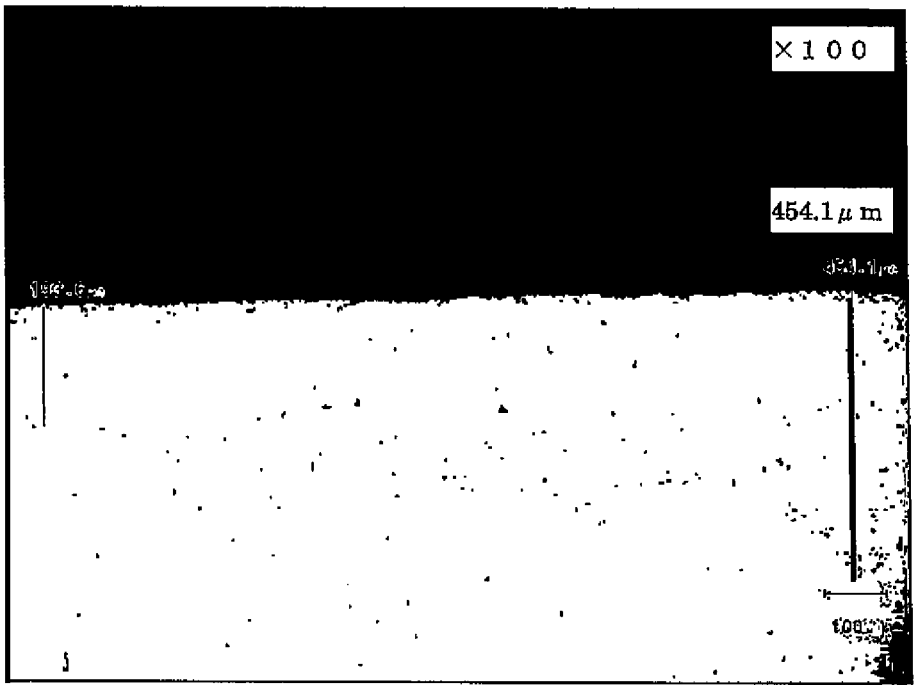
FIG. 7 is a macro photograph of the cross section of Comparative Example 18, taken at a magnification of 100 times.

A macro photograph of the cross section of the sample of the Comparative Example 18 containing no Al, taken at a magnification of 100 times, is shown in FIG. 7. Although the zinc equivalent of Comparative Example 18 is 37.39, which is almost the same as the zinc equivalent of Example 10 shown in FIG. 5, Comparative Example 18 does not contain Al. Accordingly, the degree of the progress of the dezincification phenomenon shown in FIG. 7 is generally larger than that of Example 10 containing Al, shown in FIG. 5. As a result of the measurement, the average depth was 309.9 μm, the maximum depth was 454.1 μm, and the both depths were evaluated as "×".

<Relationship Between Zinc Equivalent and Al Content>

Figure 8:
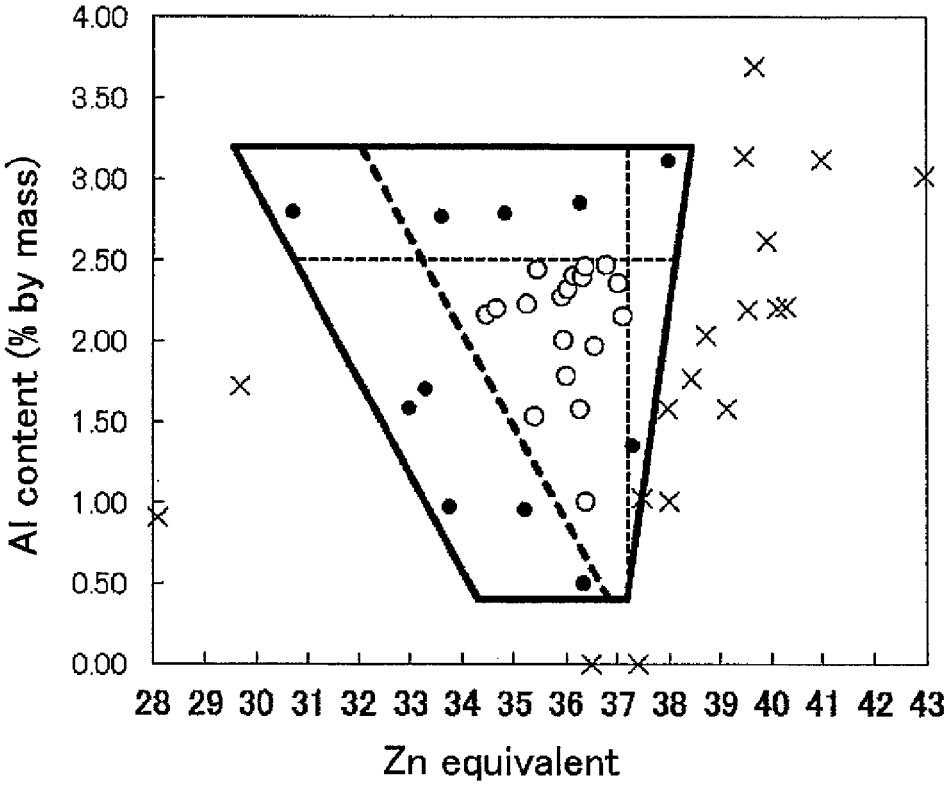
FIG. 8 is a graph obtained by plotting the Al content against the zinc equivalent in Examples and Comparative Examples.

Regarding Examples 1 to 29 and Comparative Examples 1 to 18 shown in Table 2, a graph was prepared by plotting the zinc equivalent along the X axis and the Al content along the Y axis. This graph is shown in FIG. 8. Symbols "○", "●", and "×" represent the result of the overall evaluation shown in Table 2.

Of the trapezoid represented by solid lines in the figure, the upper side line is a line representing Al=3.2% by mass, the lower side line is a line representing Al=0.4% by mass, the right side line is a line representing the above described Inequality (2), and the left side line is a line representing the above described Inequality (1). All Examples fall within this range. Conversely, all Comparative Examples fall outside this range.

Further, three straight dotted lines drawn inside the trapezoid are, respectively, a line representing Al=2.5% by mass, which is the desired upper limit of the Al content; a line representing the desired upper limit of the zinc equivalent, 37.2; and a line representing the above described Inequality (4), which is the desired range of the relationship between the zinc equivalent and the Al content. In particular, it was shown that all of the Examples evaluated as "○" in the overall evaluation fall within this desired range surrounded by the three straight lines, and that the alloys falling within this range exhibit desirable properties.

<Influence of P>

As examples having similar contents of elements other than P, the samples of Example 17, Example 20, Example 23, Example 21, and Example 19; the sample of Comparative Example 19 containing no P, which was newly prepared by melting; and the sample of Comparative Example 20 containing more than 0.3% by mass of P; arranged in the order based on the content of P, are shown in Table 3. It can be seen from the Table that the dezincification corrosion resistance is dramatically improved if P is contained, even in an amount of 0.016% by mass. This is considered to be the result of the refinement of the texture due to the presence of P so that the β-phase was divided, and of the improvement in the corrosion resistance of the α-phase due to the solid solubilization of P. On the other hand, it can be seen that the elongation is drastically reduced, when the P content is increased to greater than 0.3% by mass. Likewise, the sample of Example 22 whose P content is 0.067% by mass; and the sample of Example 31, whose contents of elements other than P are similar to those of the sample of Example 22 and whose P content is 0.003% by mass, and which was newly prepared by melting; are shown Table 4. It can be seen from the Table that, in cases where P is contained, even in an amount of only 0.003% by mass, the dezincification corrosion resistance comparable to that of Example 22 containing 0.064% by mass of P, which amounts to 20 times or more, can be obtained.

TABLE 3

| | Zn | Al | Bi | P | Cu | Zn equivalent | Equation A | Equation B | Tensile test: Tensile strength (Mpa) | Tensile test: Elongation (%) |
|---|---|---|---|---|---|---|---|---|---|---|
| Comparative Example 19 | 25.75 | 2.40 | 0.95 | 0.000 | 70.90 | 36.15 | 40.23 | 35.07 | 390.5 | 48.8 |
| Example 17 | 26.02 | 2.28 | 0.86 | 0.016 | 70.82 | 35.92 | 39.80 | 34.89 | 363.5 | 45.0 |
| Example 20 | 25.96 | 2.32 | 0.87 | 0.040 | 70.81 | 36.03 | 39.97 | 34.98 | 384.9 | 43.9 |
| Example 23 | 25.89 | 2.41 | 0.81 | 0.072 | 70.82 | 36.30 | 40.39 | 35.21 | 373.0 | 39.7 |
| Example 21 | 25.67 | 2.41 | 0.89 | 0.140 | 70.89 | 36.15 | 40.24 | 35.06 | 331.0 | 20.1 |
| Example 19 | 28.12 | 1.79 | 0.86 | 0.170 | 69.06 | 36.01 | 39.05 | 35.20 | 312.3 | 22.2 |
| Comparative Example 20 | 25.79 | 2.48 | 0.71 | 0.380 | 70.64 | 36.54 | 40.75 | 35.42 | 286.0 | 9.0 |

| | Dezincification corrosion (μm): Average depth | Dezincification corrosion (μm): Maximum depth | Tensile strength | Elongation | Ave. depth | Max. depth | Castability | Overall |
|---|---|---|---|---|---|---|---|---|
| Comparative Example 19 | 201.3 | 276.3 | ○ | ○ | X | Δ | ○ | X |
| Example 17 | 13.4 | 81.8 | ○ | ○ | ○ | ○ | ○ | ○ |
| Example 20 | 35.4 | 82.0 | ○ | ○ | ○ | ○ | ○ | ○ |
| Example 23 | 23.3 | 66.2 | ○ | ○ | ○ | ○ | ○ | ○ |
| Example 21 | 24.9 | 46.5 | ○ | ○ | ○ | ○ | ○ | ○ |
| Example 19 | 20.5 | 23.8 | ○ | ○ | ○ | ○ | ○ | ○ |
| Comparative Example 20 | 11.3 | 27.3 | ○ | X | ○ | ○ | ○ | X |

TABLE 4

| | Zn | Al | Bi | P | Cu | Zn equivalent | Equation A | Equation B | Tensile test: Tensile strength (Mpa) | Tensile test: Elongation (%) |
|---|---|---|---|---|---|---|---|---|---|---|
| Example 22 | 29.35 | 1.58 | 0.75 | 0.064 | 68.26 | 36.26 | 38.95 | 35.55 | 368.0 | 39.5 |
| Example 31 | 28.98 | 1.59 | 0.78 | 0.003 | 68.65 | 35.94 | 38.65 | 35.23 | 371.0 | 50.0 |

| | Dezincification corrosion (μm): Average depth | Dezincification corrosion (μm): Maximum depth | Tensile strength | Elongation | Ave. depth | Max. depth | Castability | Overall |
|---|---|---|---|---|---|---|---|---|
| Example 22 | 29.1 | 66.0 | ○ | ○ | ○ | ○ | ○ | ○ |
| Example 31 | 41.0 | 85.4 | ○ | ○ | ○ | ○ | ○ | ○ |

Figure 9:
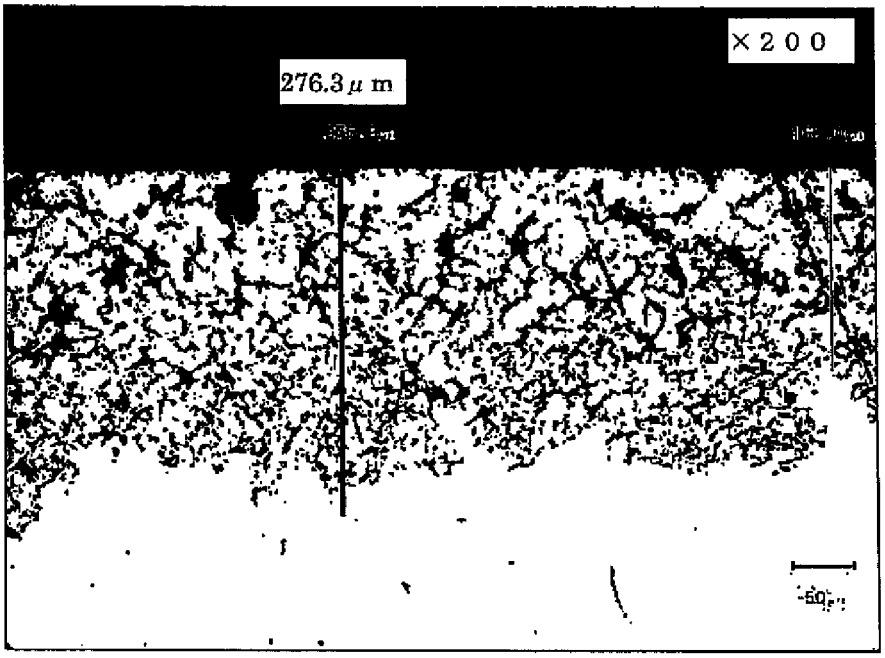
FIG. 9 is a macro photograph of the cross section of Comparative Example 19, taken at a magnification of 200 times.

Two contrasting examples are shown, regarding the difference in the degree of dezincification corrosion due to difference in the P content. Firstly, a macro photograph of the cross section of the sample of Comparative Example 19 containing no P, taken at a magnification of 200 times, is shown in FIG. 9. The entire region considered to be the β-phase is corroded, and the dezincification corrosion has progressed further into the region considered to be the discolored α-phase, although it is difficult to distinguish one from another in a black-and-white photograph. As a result of the measurement, the average depth was 201.3 μm, the maximum depth was 276.3 μm, and the average depth was evaluated as "×".

Figure 10:
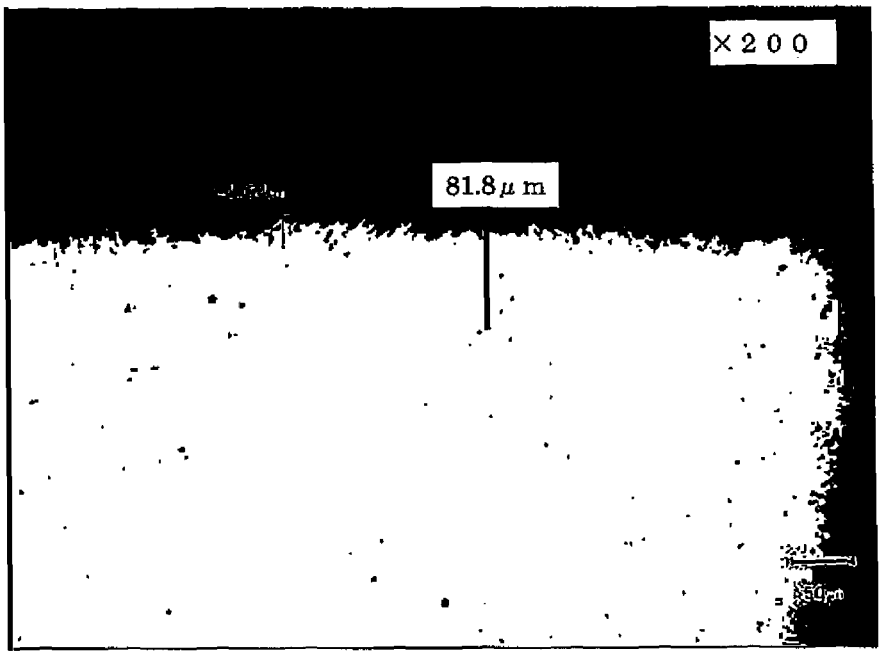
FIG. 10 is a macro photograph of the cross section of Example 17, taken at a magnification of 200 times.

Next, a macro photograph of the cross section of the sample of Example 17, whose P content is 0.016% by mass and whose contents of elements other than P are similar to those of the sample of Comparative Example 19, taken at a magnification of 200 times, is shown in FIG. 10. Only slight dezincification corrosion was observed in the region considered to be the β-phase. As a result of the measurement, the average depth was 13.4 μm, the maximum depth was 81.8 μn, and the both depths were evaluated as "○".

<Influence of Bi>

As examples having similar contents of elements other than Bi, the samples of Example 23, Example 24, Example 25, Example 28, and Example 29; the sample of Comparative Example 21 containing no Bi, which was newly prepared by melting; and the sample of Comparative Example 22 containing more than 4.5% by mass of Bi; arranged in the order based on the content of Bi, are shown in Table 5. A drastic change due to addition of Bi is not easily observed in terms of numerical values, but the elongation tends to decrease as the Bi content increases. In Comparative Example 22, the elongation was less than 15% due to too high a Bi content, and it fell outside the range suitable for a brass alloy for use in a member for water works.

Further, it can be seen that the dezincification corrosion resistance is improved in Example 23 and Example 24 containing an appropriate amount of Bi, and that Bi contributes to the improvement of the dezincification corrosion resistance. When the content of Bi is further increased, the alloy tends to be slightly more susceptible to dezincification corrosion, which is considered to be due to an increase in the zinc equivalent, as a result of a relative decrease in the Cu content. In Comparative Example 21, although the results of the tensile test and dezincification corrosion test as shown in Table 5 are favorable, large machining chips were produced, which are unsuitable for a copper alloy for use in a member for water works when the evaluation of machinability described later is taken into account.

TABLE 5

| | Zn | Al | Bi | P | Cu | Zn equivalent | Equation A | Equation B | Tensile test: Tensile strength (Mpa) | Tensile test: Elongation (%) |
|---|---|---|---|---|---|---|---|---|---|---|
| Comparative Example 21 | 25.66 | 2.38 | 0.00 | 0.070 | 71.89 | 35.71 | 39.76 | 34.64 | 356.5 | 43.6 |
| Example 25 | 26.03 | 2.46 | 0.17 | 0.026 | 71.31 | 36.39 | 40.57 | 35.28 | 389.0 | 40.8 |
| Example 23 | 25.89 | 2.41 | 0.81 | 0.072 | 70.82 | 36.30 | 40.39 | 35.21 | 373.0 | 39.7 |
| Example 24 | 25.66 | 2.40 | 1.63 | 0.092 | 70.22 | 36.33 | 40.41 | 35.25 | 369.5 | 33.2 |
| Example 28 | 25.73 | 2.47 | 2.08 | 0.050 | 69.67 | 36.79 | 40.99 | 35.68 | 380.5 | 29.7 |
| Example 29 | 26.08 | 2.36 | 2.97 | 0.116 | 68.47 | 37.01 | 41.03 | 35.95 | 367.5 | 22.6 |
| Comparative Example 22 | 26.53 | 2.31 | 4.98 | 0.088 | 66.09 | 37.93 | 41.86 | 36.89 | 337.0 | 13.9 |

| | Dezincification corrosion (μm): Average depth | Dezincification corrosion (μm): Maximum depth | Tensile strength | Elongation | Ave. depth | Max. depth | Castability | Machinability | Overall |
|---|---|---|---|---|---|---|---|---|---|
| Comparative Example 21 | 55.4 | 161.7 | ○ | ○ | ○ | ○ | ○ | X | X |
| Example 25 | 58.5 | 147.8 | ○ | ○ | ○ | ○ | ○ | ○ | ○ |
| Example 23 | 23.3 | 66.2 | ○ | ○ | ○ | ○ | ○ | ○ | ○ |

TABLE 5-continued

| | | | | | | | | | |
|---|---|---|---|---|---|---|---|---|---|
| Example 24 | 24.2 | 48.3 | ○ | ○ | ○ | ○ | ○ | ○ | ○ |
| Example 28 | 49.7 | 110.0 | ○ | ○ | ○ | ○ | ○ | ○ | ○ |
| Example 29 | 99.3 | 180.0 | ○ | ○ | ○ | ○ | ○ | ○ | ○ |
| Comparative Example 22 | 119.0 | 187.0 | ○ | X | ○ | ○ | ○ | ○ | X |

<Influence of Ni>

As examples having similar contents of elements other than Ni, the sample of Example 10 containing no Ni; and the samples of Example 32, Example 33, and Example 34, which contained Ni and which were newly prepared by melting; arranged in the order based on the content of Ni, are shown in Table 6. It was shown that the addition of Ni largely improves the dezincification corrosion resistance. Further, since the Ni content was slightly excessive in Example 34 which contained 5.17% by mass of Ni, the castability was deteriorated due to reduced flowability of molten metal and increased gas absorption, resulting in an evaluation of "Δ". In order to maintain an acceptable castability, it is necessary that the upper limit of the Ni content be kept up to this level.

TABLE 6

| | | | | | | | | | | Tensile test | |
|---|---|---|---|---|---|---|---|---|---|---|---|
| | Zn | Al | Bi | P | Cu | Ni | Zn equivalent | Equation A | Equation B | Tensile strength (Mpa) | Elongation (%) |
| Example 10 | 31.38 | 1.35 | 0.84 | 0.060 | 66.37 | 0.00 | 37.30 | 39.59 | 36.69 | 385.0 | 42.5 |
| Example 32 | 32.93 | 0.85 | 0.82 | 0.062 | 64.80 | 0.54 | 36.55 | 38.00 | 36.17 | 388.0 | 37.9 |
| Example 33 | 33.17 | 1.00 | 0.69 | 0.084 | 63.44 | 1.62 | 36.88 | 38.58 | 36.43 | 410.0 | 40.1 |
| Example 34 | 33.06 | 0.95 | 0.68 | 0.066 | 60.07 | 5.17 | 34.78 | 36.40 | 34.35 | 364.5 | 37.0 |

| | Dezincification corrosion (μm) | | | | | | | |
|---|---|---|---|---|---|---|---|---|
| | Average depth | Maximum depth | Tensile strength | Elongation | Ave. depth | Max. depth | Castability | Overall |
| Example 10 | 189.2 | 332.6 | ○ | ○ | ○ | Δ | ○ | ● |
| Example 32 | 116.0 | 184.8 | ○ | ○ | ○ | ○ | ○ | ○ |
| Example 33 | 29.8 | 15.9 | ○ | ○ | ○ | ○ | ○ | ○ |
| Example 34 | 9.8 | 15.0 | ○ | ○ | ○ | ○ | Δ | ● |

<Influence of B>

The samples of Example 35 and Example 36 which were newly prepared by melting, as examples containing no Ni and having similar contents of elements other than B; and the samples of Example 37 and Example 38 which were newly prepared by melting, as examples containing Ni and having similar contents of elements other than B; are shown in Table 7. The dezincification corrosion resistance is improved in each of Example 36 and Example 38 to which B was added, compared to Example 35 and Example 37 which contained no B. This is considered to be due to the refinement of the α-phase in the texture, and the finely divided β-phase.

TABLE 7

| | | | | | | | | | | | Dezincification corrosion (μm) | | | | | |
|---|---|---|---|---|---|---|---|---|---|---|---|---|---|---|---|---|
| | Zn | Al | Bi | P | Ni | B | Cu | Zn equivalent | Equation A | Equation B | Average depth | Maximum depth | Ave. depth | Max. depth | Castability | Overall |
| Example 35 | 30.88 | 1.12 | 0.2 | 0.030 | 0.00 | 0.0000 | 67.77 | 35.7 | 37.6 | 35.2 | 58.0 | 110.9 | ○ | ○ | ○ | ○ |
| Example 36 | 30.95 | 1.15 | 0.17 | 0.024 | 0.00 | 0.0160 | 67.69 | 35.9 | 37.8 | 35.3 | 41.2 | 96.8 | ○ | ○ | ○ | ○ |
| Example 37 | 32.01 | 1.08 | 0.23 | 0.017 | 0.75 | 0.0000 | 65.91 | 36.3 | 38.1 | 35.8 | 54.5 | 103.8 | ○ | ○ | ○ | ○ |
| Example 38 | 31.83 | 1.16 | 0.19 | 0.024 | 0.76 | 0.0110 | 66.03 | 36.4 | 38.4 | 35.9 | 33.8 | 82.72 | ○ | ○ | ○ | ○ |

Figure 11:
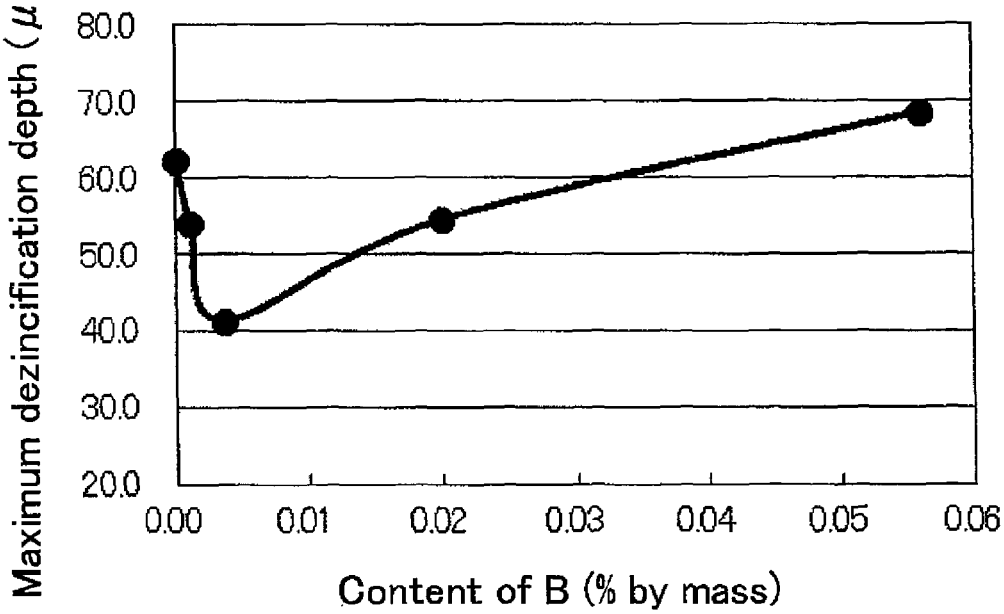
FIG. 11 is a graph obtained by plotting the maximum dezincification depth against the content of B in Examples 39 to 43.

Next, the samples of Example 39, Example 40, Example 41, Example 42, and Example 43, which have similar contents of elements other than B and which were newly prepared by melting, arranged in the order based on the content of B, are shown in Table 8. It was found that the addition of B is effective in improving the dezincification corrosion resistance, particularly in reducing the maximum dezincification depth. A graph obtained by plotting the relationship between the content of B and the maximum dezincification depth shown in Table 8, is shown in FIG. 11. It can be seen from the graph that the effect of B on the maximum dezincification depth is sufficiently demonstrated in Example 40 which contained 0.0011% by mass of B, compared to Example 39 which contained no B; and that the effect is saturated in Example 43 which contained 0.056% by mass of B. Further, in Example 43, the castability was evaluated as "Δ" due to gas defects and the like, and the overall evaluation resulted in "●". This indicates that caution is required against further deterioration of the castability and deterioration of the machinability due to hard intermetallic compounds, in cases where the B content is 0.0560% by mass or more, as in Example 43.

TABLE 8

| | Zn | Al | Bi | P | Ni | B | Cu | Zn equivalent | Equation A | Equation B | Dezincification corrosion (μm) Average depth | Maximum depth | Ave. depth | Max. depth | Castability | Overall |
|---|---|---|---|---|---|---|---|---|---|---|---|---|---|---|---|---|
| Example 39 | 31.14 | 1.12 | 0.73 | 0.047 | 0.76 | 0.0000 | 66.20 | 35.8 | 37.7 | 35.3 | 29.0 | 62.2 | ○ | ○ | ○ | ○ |
| Example 40 | 31.11 | 1.13 | 0.78 | 0.047 | 0.78 | 0.0011 | 66.15 | 35.8 | 37.7 | 35.3 | 29.2 | 54.0 | ○ | ○ | ○ | ○ |
| Example 41 | 31.42 | 1.12 | 0.70 | 0.054 | 0.78 | 0.0035 | 65.92 | 36.0 | 37.9 | 35.5 | 21.6 | 41.4 | ○ | ○ | ○ | ○ |
| Example 42 | 31.32 | 1.05 | 0.80 | 0.045 | 0.73 | 0.0200 | 66.04 | 35.7 | 37.5 | 35.2 | 29.8 | 54.6 | ○ | ○ | ○ | ○ |
| Example 43 | 31.72 | 1.08 | 0.75 | 0.056 | 0.79 | 0.0560 | 65.55 | 36.2 | 38.0 | 35.7 | 33.8 | 68.6 | ○ | ○ | Δ | ● |

In addition, B demonstrated the effect of preventing cracks in castings with complex shapes upon casting. Even in Example 39, which exhibits sufficient castability as shown in Table 8, there are cases where small cracks occur upon casting of the castings with complex shapes. However, when the same castings with complex shapes were cast using Example 40, Example 41 and Example 42, containing from 0.0011% by mass to 0.020% by mass of B, no cracks occurred. Incorporating an appropriate amount of B allows the refinement of the texture during solidification to take place, and castings with complex shapes can be suitably cast.

<Influence of Sn>

As examples having similar contents of elements other than Sn, the samples of Example 11 and Example 18 containing no Sn; and the samples of Example 44, Comparative Example 23 and Comparative Example 24, which contained Sn and which were newly prepared by melting; arranged in the order based on the content of Sn, are shown in Table 9. It was shown that, while the addition of Sn in an amount of about 0.3% by mass causes no drastic change, Sn content exceeding 0.5% by mass causes a drastic decrease in the elongation.

TABLE 9

| | Zn | Al | Bi | P | Cu | Sn | Zn equivalent | Equation A | Equation B | Tensile test: Tensile strength (Mpa) | Tensile test: Elongation (%) |
|---|---|---|---|---|---|---|---|---|---|---|---|
| Example 11 | 24.84 | 3.11 | 0.97 | 0.076 | 71.00 | 0.00 | 37.99 | 43.28 | 36.59 | 438.5 | 25.1 |
| Example 18 | 27.14 | 2.01 | 0.91 | 0.080 | 69.86 | 0.00 | 35.94 | 39.36 | 35.04 | 388.5 | 38.7 |
| Example 44 | 27.21 | 2.12 | 0.91 | 0.064 | 69.42 | 0.28 | 36.84 | 40.44 | 35.89 | 379.5 | 29.0 |
| Comparative Example 23 | 24.84 | 2.95 | 0.74 | 0.170 | 70.79 | 0.51 | 38.09 | 43.11 | 36.77 | 422.5 | 14.0 |
| Comparative Example 24 | 24.42 | 3.08 | 0.79 | 0.050 | 71.13 | 0.53 | 38.20 | 43.43 | 36.81 | 366.9 | 8.0 |

| | Dezincification corrosion (μm) Average depth | Maximum depth | Tensile strength | Elongation | Ave. depth | Max. depth | Castability | Overall |
|---|---|---|---|---|---|---|---|---|
| Example 11 | 179.8 | 306.2 | ○ | ○ | ○ | Δ | Δ | ● |
| Example 18 | 42.9 | 101.2 | ○ | ○ | ○ | ○ | ○ | ○ |
| Example 44 | 75.0 | 153.1 | ○ | ○ | ○ | ○ | ○ | ○ |
| Comparative Example 23 | 256.8 | 350.2 | ○ | X | X | Δ | Δ | X |
| Comparative Example 24 | 141.4 | 255.2 | ○ | X | ○ | Δ | Δ | X |

<Influence of Mn, Fe, Mg and Si>

As examples having similar contents of elements other than the above described elements, the sample of Example 22; and the samples of Example 45, Example 46, Example 47, Example 48 and Example 49 which were prepared by melting incorporating each of the elements Mn, Fe, Mg and Si; are shown in Table 10. It was shown that, the addition of each element in an amount of about 0.3% by mass causes no drastic change, as the addition of Sn, as long as the zinc equivalent is within the above described range.

TABLE 10

| | Zn | Al | Bi | P | Mn | Fe | Mg | Si | Cu | Zn equivalent | Equation A | Equation B | Tensile test: Tensile strength (Mpa) | Tensile test: Elongation (%) |
|---|---|---|---|---|---|---|---|---|---|---|---|---|---|---|
| Example 22 | 29.35 | 1.58 | 0.75 | 0.064 | | | | | 68.26 | 36.3 | 38.9 | 35.5 | 368.4 | 39.5 |
| Example 45 | 28.88 | 1.60 | 0.83 | 0.048 | 0.35 | | | | 68.29 | 36.1 | 38.9 | 35.4 | 375.5 | 43.8 |
| Example 46 | 29.14 | 1.59 | 0.65 | 0.052 | | 0.34 | | | 68.23 | 36.4 | 39.1 | 35.6 | 376.0 | 43.6 |
| Example 47 | 28.85 | 1.50 | 0.68 | 0.048 | | | 0.28 | | 68.64 | 35.9 | 38.4 | 35.2 | 317.2 | 25.3 |
| Example 48 | 28.93 | 1.28 | 0.82 | 0.042 | | | | 0.32 | 68.61 | 36.7 | 38.9 | 36.1 | 319.3 | 46.8 |
| Example 49 | 27.19 | 1.61 | 0.74 | 0.078 | | | | 0.33 | 70.05 | 36.4 | 39.2 | 35.7 | 322.5 | 52.7 |

| | Dezincification corrosion (μm): Average depth | Dezincification corrosion (μm): Maximum depth | Tensile strength | Elongation | Ave. depth | Max. depth | Castability | Overall |
|---|---|---|---|---|---|---|---|---|
| Example 22 | 29.1 | 66.0 | ○ | ○ | ○ | ○ | ○ | ○ |
| Example 45 | 28.1 | 52.8 | ○ | ○ | ○ | ○ | ○ | ○ |
| Example 46 | 40.6 | 99.4 | ○ | ○ | ○ | ○ | ○ | ○ |
| Example 47 | 44.9 | 87.1 | ○ | ○ | ○ | ○ | ○ | ○ |
| Example 48 | 55.7 | 88.0 | ○ | ○ | ○ | ○ | ○ | ○ |
| Example 49 | 31.9 | 60.7 | ○ | ○ | ○ | ○ | ○ | ○ |

<Verification of Machinability>

Figure 12:
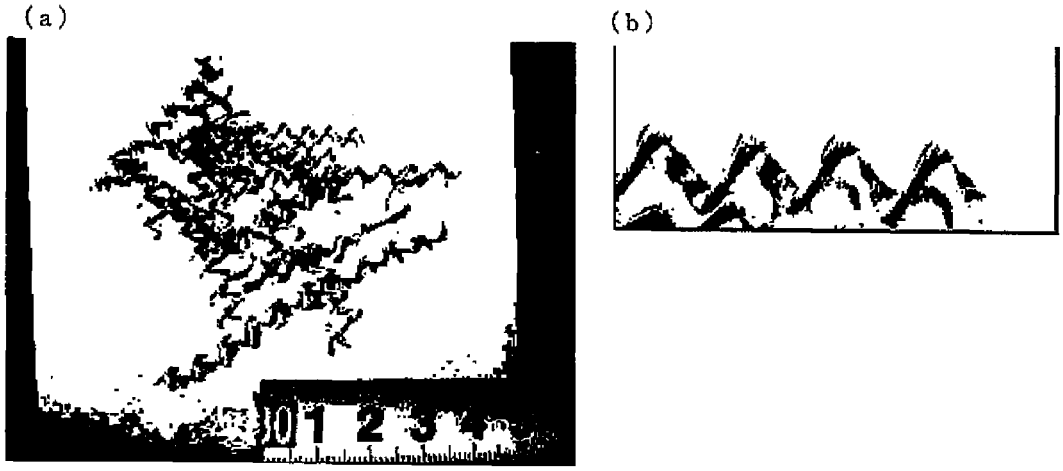
FIG. 12 shows (a) a photograph of machining chips of the alloy of Comparative Example 25, and (b) a macro photograph of (a).
Figure 13:
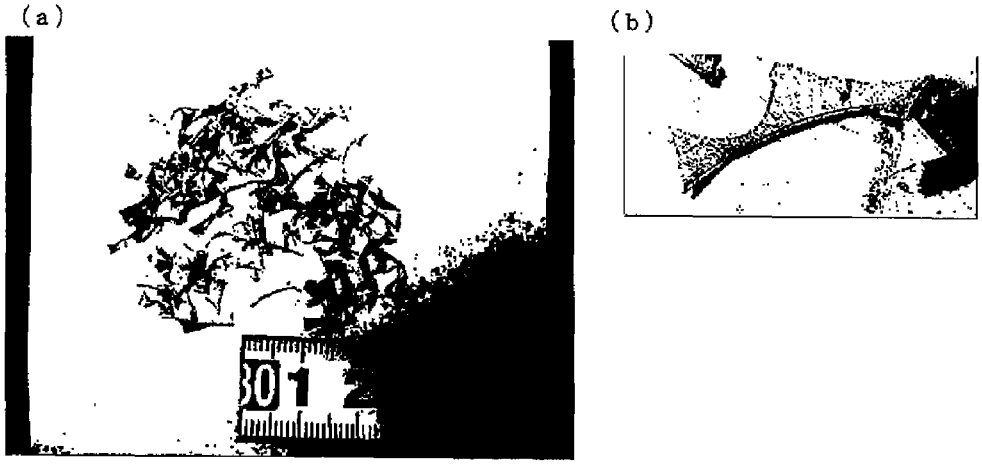
FIG. 13 shows (a) a photograph of machining chips of the alloy of Comparative Example 21, and (b) a macro photograph of (a).

The changes in the machining chips due to the difference in the machinability will now be examined, mainly in terms of the influence of the Al content relevant to the Al—P compounds which contributes to the improvement of the machinability, and the influence of the Bi content which also contributes to the improvement of the machinability. Samples for Comparative Example 21 containing Al but not containing Bi, Example 25 containing 0.17% by mass of Bi, Example 6 containing 0.69% by mass of Bi, Example 29 containing 2.97% by mass of Bi, and Comparative Example 25 containing neither Al nor Bi which was newly prepared by melting, were cast into metal molds having a size of 28 mm diameter×200 mm, and dry machined by a general lathe with a super-hard brazed tool at a feed of 0.15 mm/rev and a rotational velocity of 550 rpm, to obtain machining chips. The contents of elements in Comparative Example 25, Comparative Example 21, Example 6, Example 25 and Example 29 are shown in Table 11. The photographs thereof are shown in FIGS. 12 to 16, respectively. As shown in FIG. 12, Comparative Example 25 containing neither Al nor Bi had an extremely poor machinability, producing long machining chips which continued without break. As shown in FIG. 13, the machining chips of Comparative Example 21 which contained Al were broken into fine pieces, confirming that the machinability is improved. However, the machinability necessary for a brass alloy for use in a member for water works could not be obtained. It can be seen from FIG. 14 that the machining chips of Example 25 which contained 0.17% by mass of Bi is finely divided due to the effect of the Al—P compounds and Bi, and that the machinability is improved up to the appropriate level. Further, the comparison of FIGS. 14 to 16 confirmed that the machining chips become more finely divided as the content of Bi increases, so that the improvement of the machinability correlates with the Bi content.

TABLE 11

Figure 14:
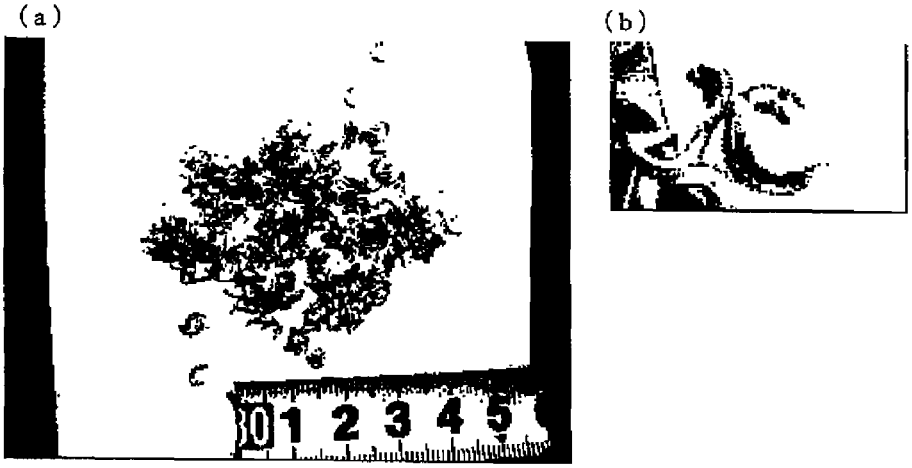
FIG. 14 shows (a) a photograph of machining chips of the alloy of Example 25, and (b) a macro photograph of (a).
Figure 15:
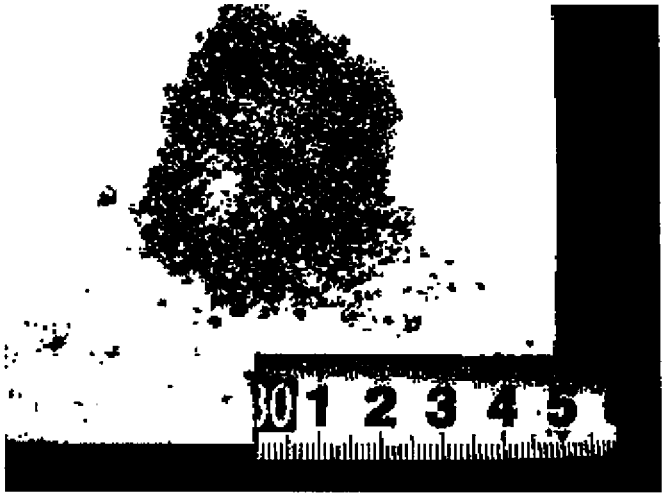
FIG. 15 shows (a) a photograph of machining chips of the alloy of Example 6, and (b) a macro photograph of (a).
Figure 15:
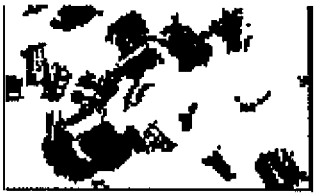
Figure 16:
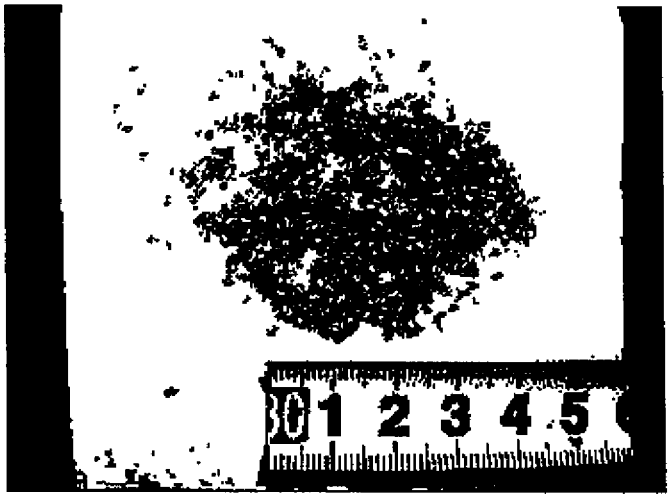
FIG. 16 shows (a) a photograph of machining chips of the alloy of Example 29, and (b) a macro photograph of (a).
Figure 16:
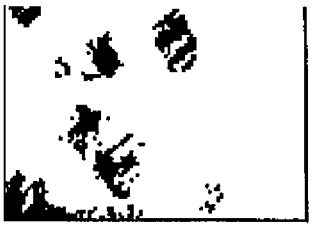

| | | Zn | Al | Bi | P | Cu | Zn equivalent | Equation A | Equation B | Machinability |
|---|---|---|---|---|---|---|---|---|---|---|
| FIG. 12 | Comparative Example 25 | 36.20 | 0.00 | 0.00 | 0.070 | 63.73 | 36.23 | 36.23 | 36.23 | X |
| FIG. 13 | Comparative Example 21 | 25.66 | 2.38 | 0.00 | 0.070 | 71.89 | 35.71 | 39.76 | 34.64 | X |
| FIG. 14 | Example 25 | 26.03 | 2.46 | 0.17 | 0.026 | 71.31 | 36.39 | 40.57 | 35.28 | ○ |
| FIG. 15 | Example 6 | 22.69 | 2.79 | 0.69 | 0.080 | 73.75 | 34.84 | 39.58 | 33.58 | ○ |
| FIG. 16 | Example 29 | 26.08 | 2.36 | 2.97 | 0.116 | 68.47 | 37.01 | 41.03 | 35.95 | ○ |

In summary, it can be seen that the alloys of the Examples of the present invention are brass alloys suitable for use in water works, which alloy has a tensile strength of 250 MPa or more, an elongation of 15% or more, an average dezincification depth of less than 200 μm, and a maximum dezincification depth of less than 400 μm, as well as a good castability and machinability.

The contents of the elements in each of Examples and Comparative Examples shown in Tables 2 to 11 are values obtained by analyzing the samples after casting, and the defined value of the content of each element in the present invention is also the content in the product after casting.

The invention claimed is:

1. A brass alloy for use in a member for water works, said brass alloy consisting of: 0.4% by mass or more and 3.2% by mass or less of Al; 0.001% by mass or more and 0.3% by mass or less of P; 0.1% by mass or more and 4.5% by mass or less of Bi; 0% by mass or more and 5.5% by mass or less of Ni; 0% by mass or more and 0.5% by mass or less of Mn, Fe, Pb, Sn, Si, Mg, and Cd, respectively; and Zn; the balance being Cu and unavoidable impurities, wherein a zinc equivalent calculated from the following equation (3) is equal to or less than 36.88:

$$Zneq=\{(Zn+\Sigma qi\cdot ti)/(Cu+Zn+\Sigma qi\cdot ti)\}\times 100 \quad (3),$$

wherein in equation (3), Cu is the content of Cu in % by mass, Zn is the content of Zn in % by mass, qi is the content of each element other than Cu and Zn in % by mass, and ti is the equivalent value corresponding to each element other than Cu and Zn, wherein the ti of Mn=0.5, the ti of Fe=0.9, the ti of Pb=1.0, the ti of Sn=2.0, the ti of Ni=−1.3, the ti of Si=10.0, the ti of Mg=2.0, the ti of Cd=1.0, and the ti of Al=6, and the content in percent by mass of Al satisfies the following Inequalities (1) and (2):

$$Zneq+1.7\times Al\geq 35.0 \quad (1)$$

$$Zneq-0.45\times Al\leq 37.0 \quad (2).$$

2. The brass alloy for use in a member for water works according to claim 1, wherein the content of Al is 2.5% by mass or less and 0.4% by mass or more of the brass alloy.

3. A brass alloy for use in a member for water works, said brass alloy consisting of: 0.4% by mass or more and 3.2% by mass or less of Al; 0.001% by mass or more and 0.3% by mass or less of P; 0.1% by mass or more and 4.5% by mass or less of Bi; 0% by mass or more and 5.5% by mass or less of Ni; 0.001% by mass or more and 0.1% by mass or less of B; 0% by mass or more and 0.5% by mass or less of Mn, Fe, Pb, Sn, Si, Mg, and Cd, respectively; and Zn; the balance being Cu and unavoidable impurities, wherein a zinc equivalent calculated from the following equation (3) is equal to or less than 36.88:

$$Zneq=\{(Zn+\Sigma qi\cdot ti)/(Cu+Zn+\Sigma qi\cdot ti)\}\times 100 \quad (3),$$

wherein in equation (3), Cu is the content of Cu in % by mass, Zn is the content of Zn in % by mass, qi is the content of each element other than Cu and Zn in % by mass, and ti is the equivalent value corresponding to each element other than Cu and Zn, wherein the ti of Mn=0.5, the ti of Fe=0.9, the ti of Pb=1.0, the ti of Sn=2.0, the ti of Ni=−1.3, the ti of Si=10.0, the ti of Mg=2.0, the ti of Cd=1.0, and the ti of Al=6, and the content in percent by mass of Al satisfies the following Inequalities (1) and (2):

$$Zneq+1.7\times Al\geq 35.0 \quad (1)$$

$$Zneq-0.45\times Al\leq 37.0 \quad (2).$$

4. The brass alloy for use in a member for water works according to claim 3, wherein the content of Al is 2.5% by mass or less and 0.4% by mass or more of the brass alloy.

* * * * *